US005231412A

United States Patent [19]

Eberhardt et al.

[11] Patent Number: 5,231,412

[45] Date of Patent: Jul. 27, 1993

[54] SLEEVED MONOPOLE ANTENNA

[75] Inventors: John E. Eberhardt, Plantation; Oscar M. Garay, Coral Springs; Yew S. Tay, Plantation, all of Fla.

[73] Assignee: Motorola, Inc., Schaumburg, Ill.

[21] Appl. No.: 780,663

[22] Filed: Oct. 18, 1991

Related U.S. Application Data

[63] Continuation-in-part of Ser. No. 632,673, Dec. 24, 1990, abandoned.

[51] Int. Cl.[5] ..... H01Q 9/320; H01Q 11/080

[52] U.S. Cl. ..... 343/790; 343/895

[58] Field of Search ..... 343/702, 895, 790–792, 343/749

[56] References Cited

U.S. PATENT DOCUMENTS

| | | | |
|---|---|---|---|
| 2,239,724 | 4/1941 | Lindenblad | 343/791 |
| 2,418,961 | 4/1947 | Wehner | 343/791 |
| 2,487,567 | 11/1949 | Lindenblad | 343/791 |
| 2,492,404 | 12/1949 | Strelb et al. | 343/791 |
| 2,704,811 | 3/1955 | Walters | 343/792 |
| 3,383,695 | 5/1968 | Jarek | 343/895 |
| 3,932,873 | 1/1976 | Garcia | 343/792 |
| 4,097,867 | 6/1978 | Eroncig | 343/895 |
| 4,644,366 | 2/1987 | Scholz | 343/748 |
| 4,730,195 | 3/1988 | Phillips et al. | 343/895 |
| 4,772,895 | 9/1988 | Garay et al. | 343/895 |
| 4,800,395 | 1/1989 | Balzano et al. | 343/895 |

FOREIGN PATENT DOCUMENTS

| | | | |
|---|---|---|---|
| 0021615 | 9/1968 | Japan | 343/792 |
| 0082246 | 7/1978 | Japan | 343/790 |

OTHER PUBLICATIONS

Translation of Japan Kokai Publication 0082246 (Jul. 1978) to Takahashi 9 pages.

Textbook: Stutzman, "Antenna Theory and Design" pp. 261–270.

*Primary Examiner*—Rolf Hille

*Assistant Examiner*—Peter Toby Brown

*Attorney, Agent, or Firm*—Juliana Agon

[57] ABSTRACT

An antenna (100) includes a quarter-wave monopole radiating element (110, 110') having a signal feed point end (110A). The antenna (100) further includes a reactive element (150) in the form of a conductive sleeve. The sleeve (150) includes a grounding end (150A) and is coaxially positioned around a portion of the monopole radiating element (110, 110'). A spacer (140) is coaxially situated between the monopole radiating element (110, 110') and the reactive element (150), for electrically insulating the monopole radiating element (110, 110') from the reactive element (150). The spacer (140) is sufficiently dimensioned such that the monopole radiating element is tightly coupled to the reactive element (150) at substantially around the feed point end (150A).

15 Claims, 3 Drawing Sheets

SLEEVED MONOPOLE ANTENNA

This application is a continuation-in-part of Ser. No. 07/632,673, filed Dec. 24, 1990, now abandoned.

TECHNICAL FIELD

This invention relates generally to monopole antennas for radiating electromagnetic signals. More particularly, the invention relates to sleeved monopole antennas for a portable radio and other communications equipment.

BACKGROUND

Relatively large antennas such as dipoles are known. Unfortunately if used on a hand held portable radio such a dipole is generally relatively large with respect to the size of the portable radio. The large size of such a dipole antenna makes it undesirable for portable radio applications. One solution to the above antenna size problem is to use a monopole antenna instead. It is well established in the field of antennas that a monopole mounted perpendicularly to a conducting surface provides an antenna having good radiation characteristics, desirable drive point impedance, and relatively simple construction. Functionally, such a monopole structure may be viewed as an asymmetric dipole in which the monopole radiating element is one element and a radio case is the other element, or the counterpoise.

A further reduction of the physical size of the antenna has generally been achieved by employing a helically wound radiator, instead of a straight wire radiator, as the monopole radiating element. Thus, the helical element occupies significantly less physical length than the corresponding straight wire radiator, but desirably exhibits the same effective electrical length.

Physical size reduction, however, reduces the operating or radiation bandwidth of the antenna because of changes in the input impedance over frequency. Furthermore, wire antennas, being good conductors, possess low resistance and hence a high Q and a low radiation bandwidth result.

One solution to the narrow bandwidth problem has been disclosed in U.S. Pat. No. 4,772,895, assigned to the assignee of the present invention, which is hereby incorporated by reference. There, two helical elements are coupled together in a fashion which results in a dramatic increase in antenna bandwidth in comparison to prior helical antennas.

Aside from size consideration, there is also a manufacturability consideration. Maintaining, controlling, or fabricating the proper pitch angle or spacing in a helical element for consistency is challenging. There is, therefore, a need for a monopole radiating structure that also provides ease of manufacturability.

SUMMARY OF THE INVENTION

Briefly, according to the invention, an antenna includes a monopole radiating element having a signal feed point end. The antenna further includes a reactive element in the form of a conductive sleeve. The sleeve includes a grounding end and is coaxially positioned around a portion of the monopole radiating element. A spacer is coaxially situated between the monopole radiating element and the reactive element, for electrically insulating the monopole radiating element from the reactive element. The spacer is sufficiently dimensioned such that the monopole radiating element is tightly coupled to the reactive element substantially around the feed point end.

In one aspect of the invention, the monopole radiating element is a straight wire radiator having approximately the same physical length as the electrical length.

In another aspect of the invention, the monopole radiating element is a helical radiator having the physical length being less than the electrical length.

In a further aspect of the invention, the reactive element is a parasitic radiator.

In one aspect of the invention, the monopole radiating element is a quarter-wavelength element having approximately the electrical length of a quarter-wavelength.

DETAILED DESCRIPTION OF THE PREFERRED EMBODIMENT

Figure 1:
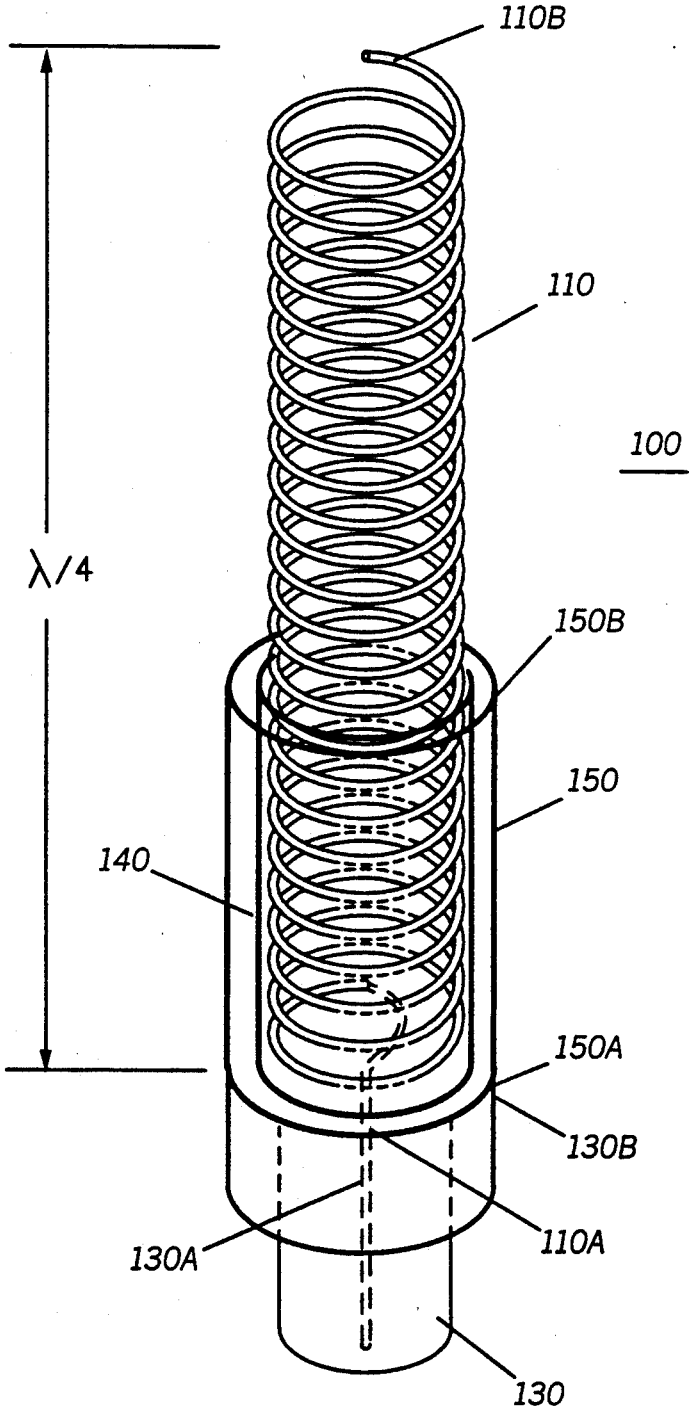
FIG. 1 is a representation of the sleeved helical antenna according to the present invention.
Figure 2:
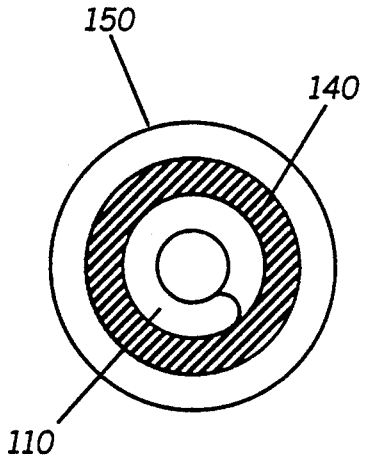
FIG. 2 is a top cross-sectional view of the antenna of FIG. 1.
Figure 3:
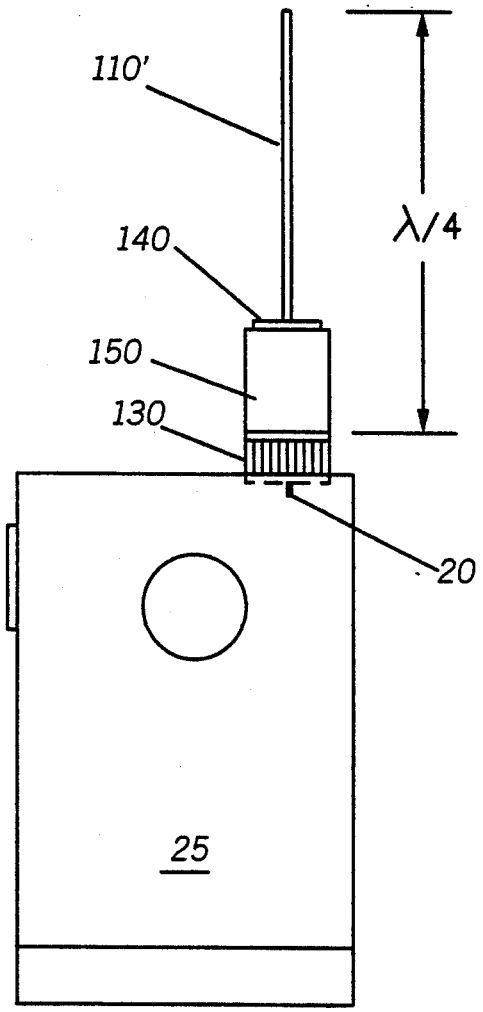
FIG. 3 is a representation of the sleeved monopole antenna according to the present invention.
Figure 4:
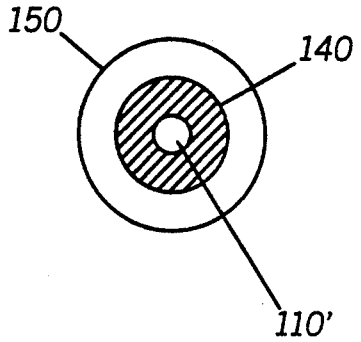
FIG. 4 is a top cross-sectional view of the antenna of FIG. 3.

Referring to FIGS. 1 and 2, one embodiment of the present invention is shown as antenna 100. The antenna 100 includes a helical primary, active, or driven radiating monopole element 110 having a helical diameter and opposed ends 110A and 110B. The primary element 110 is helically wound in this embodiment of the monopole radiating element, but need not be, as in the straight wire radiator or element 110' shown in FIGS. 3 and 4. Aside from the form of the monopole radiating element, there are no significant differences between FIG. 1 and FIG. 3. Therefore, the discussion of FIGS. 1 and 2 will relate also to FIGS. 3 and 4.

The electrical length of both the helical element 110 and the straight wire radiator 110' is somewhat less than or substantially $\lambda/4$ where $\lambda$ is the wavelength corresponding to the desired center frequency of the antenna. However, the helical element 110 occupies a physical length less than the quarter-wavelength of the straight wire radiator 110'. It is noted that the monopole element, of the present invention, may not have an electrical length of a quarter-wavelength but may be of any electrical length capable of radiation.

In order to feed radio frequency (RF) energy to and receive it from the present antenna structure, the helical end 110A is coupled to a center conductor portion 130A of a coaxial connector 130 to be coupled to the RF signal output of a radio. The coaxial connector or feed port 130 also includes a ground portion 130B which is adapted to be coupled to the radio case (not shown in FIG. 1 but shown in FIG. 3). End 110A and ground 130B together form the feedpoint of this end-fed quarter-wave monopole antenna.

A cylindrical dielectric spacer 140 is concentrically situated over or around the helical element 110 as shown in FIG. 1. In this embodiment, the spacer 140 is shaped in the form of a hollow tube, inside of which the helical element 110 is situated. While the sleeve element 150 is shown as a cylindrical shape, similar improved performance may also be obtained from other geometrically suitable shapes such as a conically or rectangularly shaped sleeve (not shown). The spacer 140 is fabricated from an appropriate dielectric material such as plastic, Teflon TM material or any other similar electrically insulated material. In this embodiment, the material utilized is the soft rubber or similar material molded or otherwise used to normally cover an antenna in a same manner as such material is used in other "rubber duck" type antennas employed on portable radios. The spacer 140 assures that the helical element 110 does not directly contact anything else other than the center conductor portion 130A of the connector 130. Specifically, the length of the spacer 140 is selected to be sufficiently long to insulate a sleeve element 150 (to be described later) from the helical element 110. However, for ease of visualization, the spacer 140 is shown slightly longer than the sleeve element 150 in FIG. 3. The thickness of the spacer 140 is selected to be sufficiently small, thin, or otherwise dimensioned such that a sleeved element, being a reactive element, is tightly coupled capacitively and inductively to the helical element 110. It is to be appreciated that the dielectric spacer 140 can be mere air if there are other ways to prevent the helical element 110 and sleeve 150 elements from touching.

The antenna 100 further includes the conductive secondary, sleeve element, or reactive element 150 having opposed ends 150A and 150B. To form the conductive sleeve for use in broadbanding, the reactive element 150 is solidly constructed out of a metal (such as thin copper sheets), other suitable conductive material, or a conductive flexible mesh instead of the solid or dense conductive material. The conductive mesh may be the well-known braid used in shielding around a conductor of a cable wire, etc. The sleeve end 150A is coupled to the ground portion 130B of the connector 130. The sleeved element 150 is positioned around and coaxially situated with respect to the helical element 110 and the spacer 150 as shown. While the sleeve 150 is shown positioned at the base of the helical element 110 and touching the rim of the ground portion 130B of the connector 130, it may not be necessary to locate the sleeve 150 so close to the connector. For example, the sleeve 150 may be positioned above the connector and only need to connect to the ground portion 130B of the connector 130 by way of a grounding strap. It is to be appreciated that the sleeve element 150 may be made integral with the connector 130 or with a part of the radio. It is further noted that the helical element 110 is longer than the sleeve element 150.

Figure 5:
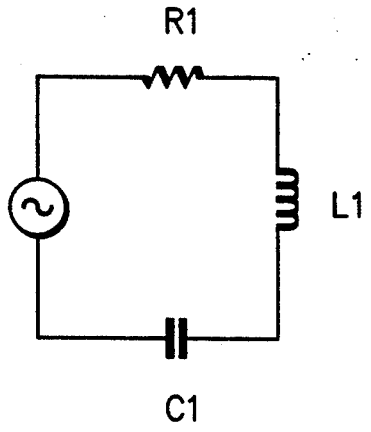
FIG. 5 is a schematic representation of a conventional monopole radiating element.
Figure 6:
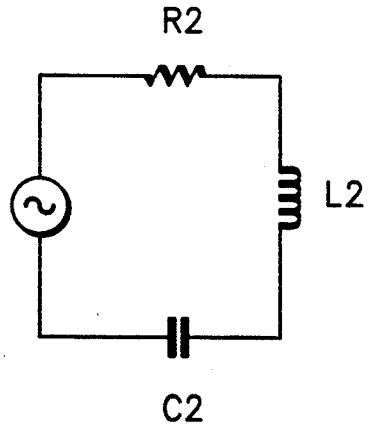
FIG. 6 is a schematic representation of the sleeve 150.

In operation, the addition of a conductive parasitic sleeve to a quarter-wave monopole antenna, in the form of a conventional helical antenna or a straight wire radiator, appears to result in a wider radiation bandwidth and matching at the connector 130 feed point. At a resonant frequency $f_o$ and radiation efficiency of interest, the equivalent input impedance of the end fed quarter-wave monopole radiating element may be represented by a series resistor (R1) -capacitor (C1) -inductance (L1) network as shown in FIG. 5. Similarly, at a resonant frequency f1, the equivalent input impedance of the sleeve 150 may be represented by a series resistor (R2) -capacitor (C2) -inductance (L2) network as shown in FIG. 6. It is noted that when the resonant frequency of the monopole or reactive element is discussed, we are referring to the resonant frequency of each element by itself in free space. That is, such resonance is determined by measuring the resonant frequency of the element prior to coupling to the other element.

Figure 7:
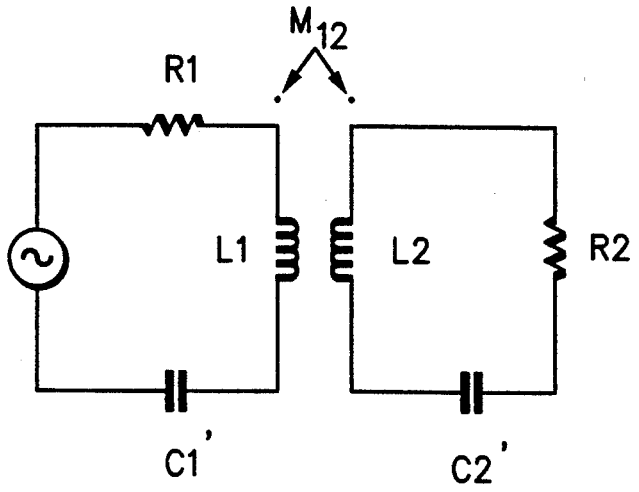
FIG. 7 is a schematic representation of the coupled structure of FIG. 1 or FIG. 3.

After tightly coupling the parasitic sleeve 150 to the monopole radiating element 110 or 110' in the region of the feedpoint, two different frequencies result from the coupled structure of FIG. 7. One resultant frequency is higher than the resonant frequency $f_o$ of the monopole radiating element while the second resultant frequency is lower than the resonant frequency f1 of the parasitic sleeve 150. Hence, if the resonant frequency f1 of the parasitic sleeve 150. Hence, if the resonant frequency of the monopole radiating element ($f_o$) is greater than that of the sleeve (f1), then an increased bandwidth results. In effect, the capacitance (C1) of the monopole has been reduced to C1' (where C1'<C1) on the coupled structure to result in an increase in resonant frequency. On the other hand, both the inductance (mutual inductance $M_{12}$ due to L1 and L2) and capacitance (C2'>C2) of the sleeve 150 are increased for the tightly coupled structure to result in a second resonant frequency lowered than the resonant frequency f1 of the sleeve 150 alone.

Thus, in order to achieve an antenna with the desired resonant center frequency and radiation bandwidth, the proper $f_o$, f1 (frequency determined by length, etc.), and spacing, or coupling, between the two elements need to be chosen. This magnitude of coupling between the monopole and sleeve (if the sleeve is touching the spacer) is a function of the thickness of the spacer 140, the dielectric constant of the spacer 140, the pitch angle if the monopole is a helical element, and the dimension of the sleeve 150.

The resultant impedance derived from the addition of the sleeve 150 to the helical element 110 appears to lessen the effect that objects in the near field of the antenna have on the antenna's impedance. Thus the present invention results in a broader impedance match having easier loading properties for the antenna.

With the tight coupling between the two elements 110 and 150, the current induced in the parasitic reactive sleeve element 150 by the excitation of the driven helical radiating element 110 may be substantial to obtain parasitic radiation if the reactive sleeve is long enough. In summary, the present antenna arrangement of a driven radiating quarter-wavelength monopole radiating element and a parasitic conductive sleeve reactive element, all interact to create a distributed reactance which results in a wider bandwidth over a conventional monopole antenna such as a single helical or straight wire element.

What is claimed is:

1. An antenna, comprising:

a quarter-wave monopole helical radiating element having an enclosed portion and an open portion, said portions having the same helical diameter, and said enclosed portion including a signal feed-point end; and a reactive element comprising a conductive sleeve for covering said enclosed portion of said helical radiating element, said conductive sleeve including a grounding end and an open end, said sleeve being coaxially positioned around said enclosed portion above said feed point end of said monopole radiating element, and said grounding end being at the same end as the feed-point end of the radiating element said conductive sleeve is insulated from and situated proximate said radiating element such that said monopole radiating element is tightly coupled to said reactive element around said feed-point end, so as to broaden the frequency response exhibited by said monopole radiating element.

2. The antenna of claim 1 wherein said reactive element is cylindrically configured.

3. The antenna of claim 1 wherein said reactive element is geometrically configured to surround said radiating element.

4. The antenna of claim 1 wherein said reactive element comprises a metallic sleeve.

5. The antenna of claim 1 wherein said reactive element is constructed from a conductive mesh.

6. The antenna of claim 1 further comprising a feed port including a signal feed portion and a ground portion, said signal feed portion being coupled to said signal feed-point end of said monopole radiating element and said ground portion being coupled to said grounding end of said conductive sleeve.

7. The antenna of claim 1 further comprising spacer means, coaxially situated between said helical monopole radiating element and said reactive element, for electrically insulating said monopole radiating element from said reactive element, said spacer means being sufficiently dimensioned such that said monopole radiating element is tightly coupled to said reactive element substantially around said feed-point end, so as to broaden the frequency response exhibited by said monopole radiating element.

8. The antenna of claim 7 wherein said spacer means comprises air.

9. The antenna of claim 7 wherein said spacer means comprises a dielectric material.

10. A radio antenna, comprising:

a feed port including a signal feed portion and a ground portion;

a quarter-wave monopole helical radiating element having an enclosed portion and an open portion, said portions having the same helical diameter, and said enclosed portion having one end being coupled to said signal feed portion of said feed port;

a reactive element comprising a conductive sleeve, said sleeve having opposed ends, a grounding end and an open end, said sleeve having a certain length which covers a certain length portion of said radiating element, said sleeve being coaxially positioned around said enclosed portion above said feed portion of said monopole radiating element, and said grounding end being at the same end as the feed portion of the radiating element, and said grounding end of said sleeve being coupled to said ground portion of said feed port; and spacer means having a minimum thickness and a dielectric constant, coaxially situated between said monopole radiating element and said reactive element to separate said radiating and reactive elements by a minimum distance, for electrically insulating said monopole radiating element from said reactive element, said spacer means being sufficiently dimensioned, in said minimum thickness at said dielectric constant, at said minimum distance, and with said certain length of said reactive element, such that said monopole radiating element is tightly coupled to said reactive element around said feed portion, so as to broaden the frequency response exhibited by said monopole radiating element.

11. The antenna of claim 10 wherein said feed port comprises a coaxial connector having the same diameter as the diameter of the sleeve, whereby it is integral with said sleeve.

12. An antenna in a communication device, comprising:

a feed port including a signal feed portion and a ground portion;

a monopole radiating helical radiating element said radiating element having an enclosed portion and an open portion, said portions having the same helical diameter, and said enclosed portion having one end, comprising a feed-point end, being coupled to said signal feed portion of said feed port;

a reactive element comprising a cylindrically configured conductive sleeve, said sleeve having a certain length which covers a certain length portion of said radiating element, said sleeve having opposed ends, a grounding end and an open end, said sleeve being concentrically positioned around said enclosed portion above said feed-point end of said monopole radiating element, said grounding end being at the same end as the feed-point end of the radiating element, and said grounding end of said sleeve being coupled to said ground portion of said feed port; and spacer means having a minimum thickness and a dielectric constant, coaxially situated between said monopole radiating element and reactive element to separate said radiating and reactive elements by a minimum distance, for electrically insulating said monopole radiating element from said reactive element, said spacer means being sufficiently dimensioned, in said minimum thickness at said dielectric constant, at said minimum distance, and with said certain length of said reactive element, such that said monopole radiating element is tightly coupled to said reactive element around said feed portion to form a quarter-wave broadbanded antenna, whereby said monopole radiating element is tightly coupled to said reactive element.

13. The antenna of claim 12 wherein said reactive element comprises a parasitic radiator.

14. The antenna of claim 12 wherein said monopole radiating element comprises a quarter-wavelength element having an electrical length of a quarter-wavelength.

15. The antenna of claim 12 wherein said feed port comprises a coaxial connector.

* * * * *